United States Patent [19]

Haydock

[11] 4,198,798

[45] Apr. 22, 1980

[54] ANCHOR BOLT SLEEVE

[76] Inventor: Charles E. Haydock, 390 Ridgefield Rd., Wilton, Conn. 06897

[21] Appl. No.: 809,121

[22] Filed: Jun. 22, 1977

[51] Int. Cl.[2] ..... E04B 1/41

[52] U.S. Cl. ..... 52/699; 52/704

[58] Field of Search ..... 85/1 R, 1 K, 1.5 R; 52/699, 701, 704, 707, 708, DIG. 11, 295; 151/41.73, 41.7

[56] References Cited

U.S. PATENT DOCUMENTS

| | | | |
|---|---|---|---|
| 1,645,903 | 10/1927 | Garber | 52/708 |
| 3,430,408 | 3/1969 | Dean | 52/699 |
| 3,500,607 | 3/1970 | Wilson | 52/704 X |
| 3,640,328 | 2/1972 | Tummarello | 151/41.7 |
| 3,646,982 | 3/1972 | Cushman | 151/41.7 |
| 3,867,804 | 2/1975 | Wilson | 52/704 X |
| 3,964,531 | 6/1976 | Schenk | 151/41.7 |
| 4,027,711 | 6/1977 | Tummarello | 151/41.7 |
| 4,117,643 | 10/1978 | Lamothe | 52/699 |

FOREIGN PATENT DOCUMENTS

| | | | |
|---|---|---|---|
| 316089 | 11/1956 | Switzerland | 151/41.73 |
| 683700 | 12/1972 | United Kingdom | 52/708 |

*Primary Examiner*—Rodney H. Bonck

*Attorney, Agent, or Firm*—McCormick, Paulding & Huber

[57] ABSTRACT

An adjustable pipe sleeve for an anchor bolt comprises a length of cylindrical pipe supported in depending position on an anchor bolt by an adapter assembly which includes one part threaded onto an upper end portion of the bolt and another part threadably engaged with the upper end of the pipe. Coengagable bearing surfaces on the parts cooperate to maintain the pipe in an adjusted axial position and in coaxial alignment with the bolt.

15 Claims, 3 Drawing Figures

ANCHOR BOLT SLEEVE

BACKGROUND OF THE INVENTION

This invention relates in general to anchor bolt forms and deals more particularly with improved pipe sleeves for anchor bolts and the like.

A typical pipe sleeve of the type commonly used in the construction industry to form a void around an anchor bolt embedded in concrete comprises a length of cylindrical pipe which has a plate tack welded across its lower end. An anchor bolt is inserted upwardly through a pre-drilled or punched hole in the plate and through the sleeve. The pipe sleeve is then secured to the bolt in a predetermined axial position by tack welding the plate to the shank of the bolt. The sleeve is open at its upper end, however, it is customary to stuff the open end with waste to prevent foreign material and moisture from entering the void formed by the sleeve until such time as the void is filled with concrete or other suitable material.

While pipe sleeves of the aforedescribed general type have gained wide acceptance in the construction industry, there are recognized disadvantages in the use of such sleeve structures. Apart from the relatively high cost of materials, skilled labor is needed to perform the necessary welding operations to fabricate such sleeves and assemble the sleeves with bolts. If welding equipment is not available at the construction site, sleeves must be assembled with anchor bolts elsewhere and transported to the job site in assembled condition which introduces problems in transportation and handling. After a pipe sleeve has been welded into assembly with a bolt, it can no longer be adjusted relative to the bolt to compensate for an unexpected condition encountered when the assembly is put in position at the job site. Further, the practice of stuffing the open ends of pipe sleeves to prevent contamination is generally recognized as an unsatisfactory solution to the problem. If the sleeve openings are not stuffed, or if the stuffing material becomes dislodged, the voids are likely to become contaminated with foreign material or moisture which must be removed before finishing operations can be completed.

It is the general aim of the present invention to provide improved pipe sleeves for anchor bolts which may be readily assembled on bolts by persons of ordinary skill and without special tools or equipment. It is the further aim of the invention to provide improved pipe sleeves which may be readily adjusted relative to bolts to compensate for variations in job site conditions and which positively prevent void contamination. A still further aim of the invention is to provide a pipe sleeve adapter assembly for use with standard pipe to form an adjustable anchor bolt sleeve.

SUMMARY OF THE INVENTION

In accordance with the present invention, an improved adjustable sleeve for an anchor bolt is provided which comprises a length of cylindrical pipe for receiving the bolt therethrough and an adapter assembly which includes an outer part for threadable connection with the upper end of the pipe and an inner part for threadable engagement with the upper end of the bolt. The inner and outer parts have co-engageable bearing surfaces which cooperate to maintain the pipe sleeve in coaxial alignment with the bolt and support it in predetermined axial position relative to the bolt. The inner and outer parts further cooperate to provide a closure for the upper end of the pipe and are readily removable to expose the void within the pipe. After the adapter assembly has been removed from the pipe, it may be used with another length of pipe to form another pipe sleeve.

DETAILED DESCRIPTION OF PREFERRED EMBODIMENTS

Figure 1:
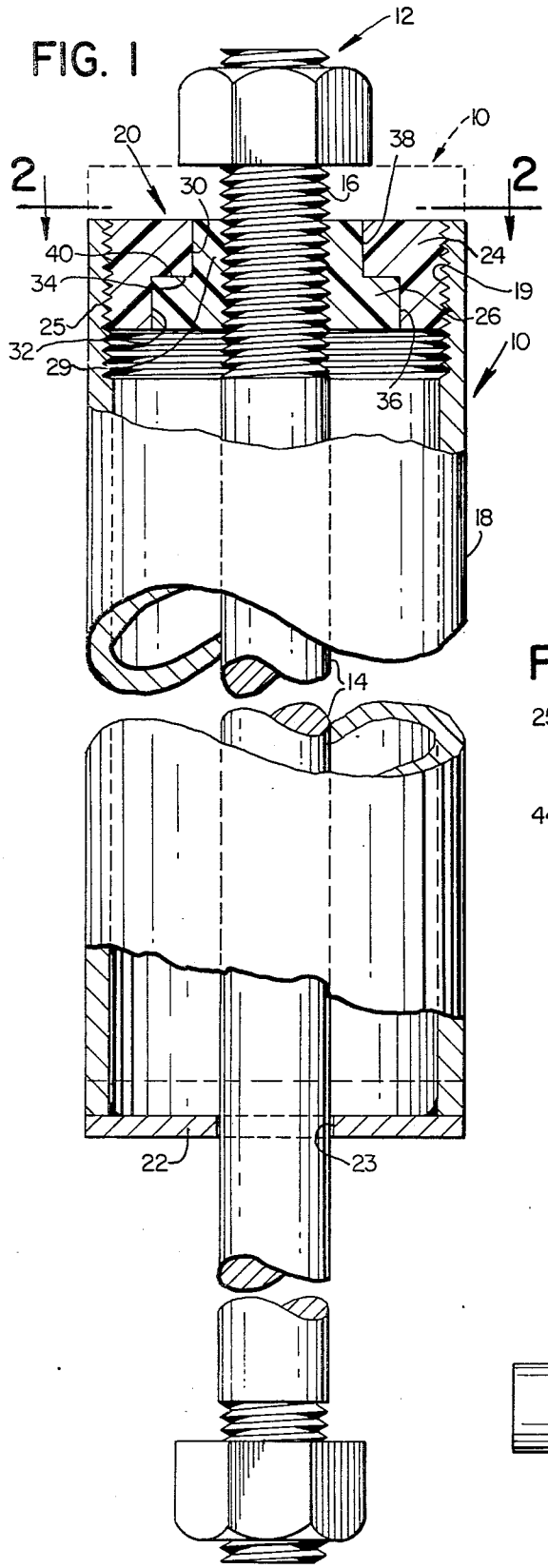
FIG. 1 is a fragmentary side elevational view of a pipe sleeve embodying the present invention shown mounted on an anchor bolt and partially in vertical axial section.
Figure 2:
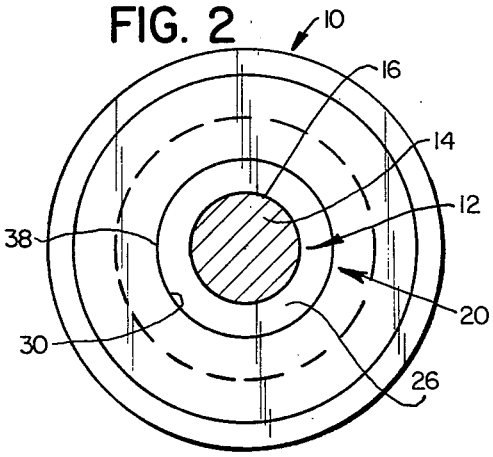
FIG. 2 is a sectional view taken along the line 2—2 of FIG. 1.

Referring now to the drawings, an anchor bolt form or a pipe sleeve embodying the present invention and indicated generally by the reference numeral 10 in FIGS. 1 and 2 is shown mounted on an anchor bolt designated generally by the numeral 12. The illustrated bolt 12, shown oriented in an axially vertical position, has an elongated shank 14 and a threaded upper end portion indicated at 16. The lower end of the bolt may be of any suitable configuration, however, the illustrated bolt 12 is threaded at its lower end to receive a nut.

The pipe sleeve 10 generally comprises a length of cylindrical pipe 18 which has an internal thread 19 at its upper end and an adapter assembly 20 for threadable connection to the upper end of the pipe and to the anchor bolt 12 to support the pipe 18 in depending position on the bolt and to maintain it in generally coaxial alignment with the bolt. Preferably, and as shown, the pipe sleeve 10 also includes a bottom member or plate 22 which provides a closure for the lower end of the pipe 18. The plate 22 is welded or otherwise attached to the lower end of the pipe 18 and has a central hole 23 for receiving the bolt shank 14 therethrough. The diameter of the hole 23 is substantially equal to or slightly larger than the diameter of the bolt shank so that the bolt shank may pass freely therethrough.

The adapter assembly 20 may be made from any suitable material, but preferably and as shown, it is molded from plastic and comprises an outer part or ring member 24 and an inner part or nut member 26. The ring member 24 has a thread 25 on its annular peripheral surface for engaging the thread 19. A stepped bore extends coaxially through the ring member 24 and defines a plurality of bearing surfaces which include radially inwardly facing bearing surfaces 30 and 32, respectively, defined by the lower and upper portions of the bore and an axially downwardly facing bearing surface 34 intermediate the upper and lower portions. The nut member 26 comprises a generally cylindrical nut threaded for engagement with the upper end of the bolt 12. The annular peripheral surfaces of the nut 26 generally complement the surfaces of the bore 29. More specifically, the nut 26 has generally radially outwardly facing annular bearing surfaces 36 and 38 for complementary engagement with the inwardly facing bearing surfaces 30 and 32. The nut 26 further defines a generally axially upwardly facing bearing surface 40 which substantially complements the downwardly facing bearing surface 34 on the ring member. When the nut member 26 is assembled with the bolt 12 and the ring member 24 is connected to the pipe 18, the co-engageable bearing surfaces on the two members 24 and 26 co-operate to maintain the pipe 18 in coaxial alignment with the bolt 12.

In assemblying the pipe sleeve 10 with the bolt 12, the bolt is inserted upwardly through the hole 23 and through the pipe 18. Thereafter, the nut member 26 is then threaded onto the upper end of the bolt 12 to an approximate position of adjustment. The ring member 24 is then threaded into the upper end of the pipe 18 until the upper surface of the ring member is substantially disposed within the plane of the upper end of the pipe. It should be noted that when the pipe sleeve 10 is assembled with the bolt 12 the ring member 24 and the nut member 26 cooperate to provide a closure or the upper end of the pipe 18. Further, the upper surface of the ring member and the nut member lie substantially within the plane of the upper end of the pipe to provide a substantially planar surface. In the assembled condition, shown in FIG. 1, the upper end of the nut member 26 is accessible externally of the pipe 18 so that the nut member 26 may be rotated in one or in an opposite direction relative to the bolt 12 to adjust the angular positioning of the sleeve 10 relative to the bolt.

After the bolt 12 and the pipe sleeve 10 have been embedded in a concrete foundation or the like, the adapter assembly 20 may be removed to expose the void around the bolt. The ring member 24 is first threaded out of engagement with the pipe 18. Thereafter, the nut member may be threaded out of engagement with the bolt 12. The adapter assembly 20 may then be used with another length of pipe and another bolt to form another pipe sleeve assembly.

Figure 3:
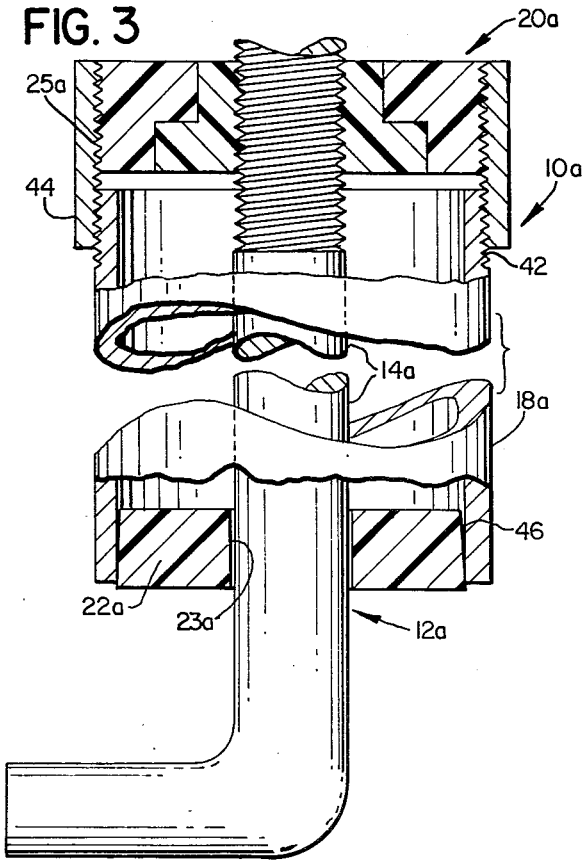
FIG. 3 is similar to FIG. 1, but shows another embodiment of the invention.

The present invention may be practiced with a standard pipe which is either internally or externally threaded at its upper end. Referring now to FIG. 3 another pipe sleeve embodying the present invention and indicated generally by the reference numeral **10*a* is shown connected to an anchor bolt 12*a* which has an L-shaped head at its lower end to provide a firm footing in a concrete foundation or the like. The sleeve 10*a* includes an axially elongated length of pipe designated 18*a* which has an external thread at its upper end. The pipe sleeve 10*a* further includes an adapter assembly 20*a* substantially identical to the adapter assembly 20 previously described. A threaded coupling member which comprises a standard pipe coupling 44 is used to connect the adapter assembly 20*a* to the upper end of the pipe 18*a***, substantially as shown. Thus, the same adapter assembly may be utilized with either type of pipe.

The pipe assembly **10*a* also has a bottom member of plug 22*a* which provides a closure for the lower end of the pipe. The plug 22*a* is adapted for force fit engagement within the lower end of the pipe 18*a*. Preferably, and as shown, it is molded from plastic material and has a central hole 23*a* for receiving the bolt 12*a* therethrough. The annular peripheral surface of the plug 22*a* designated by the numeral 46** is or may be slightly tapered to facilitate forceable assembly within the lower end of the pipe.

I claim:

1. An adjustable sleeve for an anchor bolt having an axially elongated shank threaded at its upper end, said sleeve comprising a cylindrical pipe for receiving the anchor bolt therethrough and having an inside diameter substantially larger than the diameter of the anchor bolt shank, and an adapter assembly including an outer part having a central bore for receiving the bolt therethrough, said central bore having a cross sectional area substantially greater than the cross sectional area of an associated portion of the anchor bolt, means connecting the outer part to the upper end of said pipe with said bore in general coaxial alignment with said pipe, said adapter assembly including an inner part engageable with said outer part within said bore and having an internal thread for engaging the threaded upper end of the anchor bolt, said inner and outer parts having coaxially symmetrical annular co-engaging bearing surfaces cooperating in complementary co-engagement with each other in all angular positions of said inner part relative to said outer part to maintain the upper end portion of of said pipe in coaxial alignment with the upper end portion of the anchor bolt, said inner and outer parts cooperating in assembly with said bolt and the pipe to define a closure for the upper end of said pipe, said inner part in engagement with said outer part having a portion thereof exposed at the upper end of said bore and externally accessible at said upper end.

2. An adjustable sleeve for an anchor bolt as set forth in claim 1 wherein said pipe is threaded at its upper end and said connecting means comprise a thread on said outer part.

3. An adjustable sleeve for an anchor bolt as set forth in claim 2 wherein said connecting means comprises a threaded coupling for connecting said outer part to said pipe.

4. An adjustable sleeve for an anchor bolt as set forth in claim 1 wherein said bearing surfaces include a generally axially upwardly facing bearing surface on said inner part and a generally axially downwardly facing bearing surface on said outer part.

5. An adjustable sleeve for an anchor bolt as set forth in claim 1 wherein said bearing surfaces include a generally radially outwardly facing bearing surface on said inner part and a generally radially inwardly facing bearing surface on said outer part.

6. An adjustable sleeve for an anchor bolt as set forth in claim 1 wherein said outer part comprises a ring member and said inner part comprises a generally cylindrical nut member engageable with said ring member within said bore.

7. An adjustable sleeve for an anchor bolt as set forth in claim 1 wherein said pipe sleeve includes means for maintaining the lower end portion of said cylindrical pipe in generally coaxial alignment with an associated portion of the anchor bolt shank.

8. An adjustable sleeve for an anchor bolt as set forth in claim 1 wherein said maintaining means comprises means cooperating with an associated portion of the anchor bolt shank for forming a closure for the lower end of said pipe.

9. An adjustable sleeve for an anchor bolt as set forth in claim 8 wherein said maintaining means comprises a plate connected to the lower end of said pipe and having a circular central opening therethrough substantially equal in diameter to the diameter of the associated portion of the anchor bolt shank.

10. An adapter assembly for adjustably supporting a pipe sleeve on an anchor bolt and comprising an outer part having a central bore for receiving an associated portion of the bolt therethrough, said bore having a cross sectional area substantially greater than the cross sectional area of the associated portion of the bolt, an external thread on said outer part for connecting the outer part to one end of the pipe with said bore in general coaxial alignment with the pipe, and an inner part having an internal thread for threadably engaging the bolt and engageable with said outer part within said bore, the annular peripheral surface of said inner part and said bore defining coengageable coaxially symmetrical annular bearing surfaces for cooperating in complementary coengagement with each other in all angular positions relative to each other to maintain the one end of the pipe in coaxially alignment with an associated end of the bolt, said inner part in engagement with said outer part having a portion thereof exposed externally of the pipe at its one end.

11. An adapter assembly as set forth in claim 10 wherein said bearing surfaces comprise annular bearing surfaces.

12. An adapter assembly as set forth in claim 11 wherein a peripheral surface of said inner part compliments the bore surface and said peripheral surface and said bore surface comprise said bearing surfaces.

13. An adapter assembly as set forth in claim 12 wherein said outer part comprises a threaded ring and said inner part comprises a generally cylindrical nut.

14. An adjustable sleeve for an anchor bolt having an axially elongated shank threaded at its upper end, said sleeve comprising a cylindrical pipe for receiving the anchor bolt therethrough, said pipe being threaded at its upper end and having an inside diameter substantially larger than the diameter of the anchor bolt shank, and an adapter assembly including an outer part having a central bore for receiving the bolt therethrough, said central bore having a cross sectional area substantially greater than the cross sectional area of an associated portion of the anchor bolt, a thread on said outer part threadably connecting the outer part to the upper end of said pipe with said bore in general coaxial alignment with said pipe, said adapter assembly including an inner part engageable with said outer part within said bore and having an internal thread for engaging the threaded upper end of the anchor bolt, said inner and outer parts having co-engaging bearing surfaces for cooperating to maintain the upper end portion of said pipe in coaxial alignment with the upper end portion of the anchor bolt, said inner and outer parts cooperating in assembly with said bolt and the pipe to define a closure for the upper end of said pipe, said inner part in engagement with said outer part having a portion thereof exposed at the upper end of said bore and externally accessible at said upper end.

15. An adjustable sleeve for an anchor bolt as set forth in claim 14 wherein said bearing surfaces comprise annular bearing surfaces.

* * * * *